US005802749A

United States Patent [19]

Barmentlo et al.

[11] Patent Number: 5,802,749

[45] Date of Patent: Sep. 8, 1998

[54] IRON AND ACCUMULATED ENERGY TRANSFERRING STAND

[75] Inventors: Maarten Barmentlo, Groningen; Gerrit Bijker, Veldhoven; Robert E. F. Einerhand, Eindhoven; Paul A. J. Ackermans, Eindhoven; Jan P. Elkhuizen, Eindhoven; Adriaan Netten, Drachten, all of Netherlands

[73] Assignee: U.S. Philips Corporation, New York, N.Y.

[21] Appl. No.: 764,833

[22] Filed: Dec. 12, 1996

[30] Foreign Application Priority Data

Dec. 14, 1995 [EP] European Pat. Off. ..... 95203486

[51] Int. Cl.[6] ..... D06F 75/02; D06F 79/02

[52] U.S. Cl. ..... 38/82; 38/84; 38/96

[58] Field of Search ..... 38/75, 77.3, 74, 38/77.7, 77.6, 73.82, 79, 84, 82, 77.83, 107, 96; 219/246, 247, 250, 254, 258, 259, 600, 618, 646

[56] References Cited

U.S. PATENT DOCUMENTS

| | | | |
|---|---|---|---|
| 5,189,726 | 2/1993 | Pan | 38/77.6 X |
| 5,315,773 | 5/1994 | Iwani et al. | 38/107 X |

FOREIGN PATENT DOCUMENTS

| | | | |
|---|---|---|---|
| 574602 | 12/1993 | European Pat. Off. | 38/77.3 |
| 2626207A1 | 12/1977 | Germany . | |
| 3538544A1 | 5/1987 | Germany . | |
| 2128800A | 5/1990 | Japan . | |
| 3070599 | 3/1991 | Japan | 38/96 |
| 3090199 | 4/1991 | Japan | 38/82 |
| 3264097 | 11/1991 | Japan | 38/77.3 |
| 3272800 | 12/1991 | Japan | 38/82 |
| WO8803579 | 5/1988 | WIPO . | |

*Primary Examiner*—Ismael Izaguirre
*Attorney, Agent, or Firm*—Ernestine C. Bartlett

[57] ABSTRACT

The recharging time for reheating the soleplate of an iron can considerably be reduced by accumulating energy from an energy supply, e.g. the mains, in a stand for the iron and by transferring this energy to the iron when the iron is attached to the stand. The iron is reheated very quickly, e.g. by exchanging cooled down liquid from the iron with hot liquid accumulated in the stand every time the iron is put back in the stand.

11 Claims, 3 Drawing Sheets

IRON AND ACCUMULATED ENERGY TRANSFERRING STAND

BACKGROUND OF THE INVENTION

The invention relates to an iron arrangement comprising a cordless iron and a stand, said iron having a soleplate, said stand receiving energy from an energy supply, said arrangement comprising transfer means for transferring said energy to the iron for heating said iron when the iron is attached to the stand.

In the present cordless iron arrangements the iron comprises a electric heating element for heating the soleplate. The stand is connected to the electric mains as an energy supply. When the iron is attached to the stand the heating element is electrically connected to the mains for heating the soleplate to accumulate an amount of thermal energy in the soleplate. The soleplate can be considered as a kind of heat accumulator. This enables the user to use the iron for a certain period of time without the iron being connected to the mains by means of a cord. A drawback of these known arrangements is that the time during which the iron is attached to the stand for reheating the soleplate, called the idle time, is too short, in addition to which the maximum power available from the mains is limited. A maximum ironing time is about 15 seconds. The idle time, used for re-arranging the fabric, which is equal to the time for reheating the soleplate, is only a few seconds. Often this time is not long enough to reheat the soleplate sufficiently. Usually the user does not wait until the selected temperature of the iron soleplate is reached, so that ironing takes place at too low a temperature resulting in a poor ironing performance. Moreover a maximum ironing time of 15 seconds is often too short. Users would like to have the possibility to iron for a longer period of time.

SUMMARY OF THE INVENTION

The object of the invention is to provide a cordless ironing arrangement in which a cordless iron can be used for a relative long period of time and with a soleplate temperature which remains sufficiently high during the ironing operation and in which reheating of the soleplate requires a minimum of time.

The present invention provides an iron arrangement comprising a cordless iron and a stand, said iron having a soleplate, said stand receiving energy from an energy supply, said arrangement comprising transfer means for transferring said energy to the iron for heating said soleplate when the iron is attached to the stand, characterized in that the stand comprises means for accumulating said energy, said transfer means transferring said accumulated energy when the iron is attached to the stand. The advantage is that there is continuous accumulation of energy in the stand, i.e. during the real ironing time as well as during the idle time of the iron, so that every time the iron is attached to the stand there is always enough energy accumulated in the stand for transferring the energy to the iron for reheating the soleplate to the desired temperature. The accumulated energy is transferred to the iron during the relatively short time, i.e. when the iron is attached to the stand. For transferring the accumulated energy only a short time is needed to reheat the soleplate sufficiently, whereas in the known cordless irons a much longer time is needed to reheat the soleplate to about the same temperature, because now more energy can be transferred to the iron per unit of time than when the iron receives the energy directly from e.g. the mains, as is the case in the known cordless irons. There is no dependence on the maximum available power from the mains.

In an embodiment of the invention the means for accumulating energy comprises a storage tank containing a liquid, said stand comprising heating means for heating the liquid in the storage tank, said iron having a soleplate and a reservoir for receiving said heated liquid from the storage tank, said heated liquid in the reservoir being in heat-conducting contact with the soleplate for heating said soleplate, both said reservoir and said storage tank comprising an inlet and an outlet tube for the liquid, the respective inlet and outlet tubes of the reservoir and the storage tank being connectable to each other when the iron is attached to the stand, said stand comprising a pump for pumping the liquid from the storage tank to the reservoir and vice versa. Instead of heating the soleplate with a customary electric heating element, the soleplate is heated with a hot liquid. Each time the iron is attached to the stand, the cooled liquid in the iron is replaced by hot liquid from the stand. To use an iron for all kind of fabrics, it should be possible to heat the soleplate to a temperature of 200°–220° C., which means that the liquid in the reservoir must have at least that temperature. Many kinds of liquids can be used such as oil-like liquids, such as glycerol. When the iron is attached to the stand and the connections have been made, hot liquid is pumped from the storage tank to the reservoir in the iron and cooled down liquid from the reservoir is pumped back to the storage tank. The relatively short idle time in which the iron is attached to the stand is sufficient to exchange the liquid. The liquid in the reservoir heats the soleplate very quickly, so that the iron, is again directly ready for use. The liquid in the reservoir serves as a heating buffer for the soleplate. The liquid in the storage tank is reheated during the usually longer ironing time as well as during the idle time. In a preferred embodiment of the invention the means for accumulating energy comprises a first and a second storage chamber each containing a liquid, said stand comprising heating means for heating the liquid in either the first or the second storage chamber, said iron having a soleplate and a reservoir for receiving said heated liquid from one of the storage chambers, said heated liquid in the reservoir being in heat-conducting contact with the soleplate for heating said soleplate, said reservoir comprising an inlet and an outlet tube for the liquid, said storage chambers each having one connecting tube for the liquid, the inlet and the outlet tubes of the reservoir being connectable to the respective connecting tubes of the storage chambers when the iron is placed on the stand. In this embodiment a pump is not necessary. The storage tanks are filled with liquid, leaving an air space above the liquid. The system is continuously operating under vapour/air pressure. The exchange of liquid from the stand to the iron and vice versa is possible due to the pressure difference between the storage tanks. After heating of the liquid in the first storage tank the pressure in the first storage tank is higher than in the reservoir of the iron and higher than in the second storage tank. The temperature in the iron reservoir decreases due to the ironing process. When the iron is attached to the stand and connections have been made, liquid from the first storage tank is forced to the reservoir and at the same time liquid from the reservoir is forced to the second storage tank. The exchange takes place very rapidly. After the exchange of liquid, the liquid in that storage chamber which at that moment has the lowest temperature, is heated until the selected temperature is reached. The next time that the iron is again attached to the stand the liquid will be forced in the opposite direction.

When the cordless iron is attached to the stand, the inlet and outlet tubes of the iron must be connected to the tubes of the stand. There is always a chance that liquid will leak, especially because the liquid is under pressure. Therefore, preferably water is used for the liquid. Water does not smudge the fabric. Moreover, when a droplet of water escapes from the system, it will usually evaporate immediately, because the temperature of the water is far beyond 100° C. Another advantage is that water has excellent thermal properties. Water has a better thermal conductivity and a greater specific heat capacity compared to many other liquids.

In another embodiment the means for accumulating energy comprises a motor driven flywheel having a plurality of magnets, said iron having a magnetizable plate which is in heat-conducting contact with the soleplate, the accumulated rotational energy of the flywheel being transferred to the magnetizable plate by induction for heating the sole plate when the iron is attached to the stand. A spinning flywheel contains an amount of rotational energy. It is possible to transfer this rotational energy to the iron and convert it into heat. This could be done by converting the rotational energy into electric energy via a generator and then applying the electric energy to heat the soleplate. However, this solution is rather expensive and bulky. A better solution is to convert the rotational energy directly into heat in the soleplate of the iron by means of an inductive coupling between the flywheel and the soleplate.

In another embodiment the means for accumulating energy comprises a capacitor, said cordless iron comprising a soleplate and an electric heating resistor being in thermal contact with the soleplate, the electric charge accumulated in the capacitor being transferred to the resistor through electric conductors for heating the soleplate when the iron is attached to the stand. In a capacitor an amount of energy can be stored in the form of electric charge. This charge can be transferred very quickly to the resistor of the iron for heating the soleplate, resulting in a reduction of recharging time for the iron.

In another embodiment the iron arrangement is characterized in that, when the iron is attached to the stand, the accumulated energy is transferred to the iron for heating a steam chamber whereas the soleplate is heated by means of electric energy received directly from the electric mains via the stand. Heating of the iron takes place from two sources. The steam chamber is heated by means of the accumulated energy and the soleplate is heated by means of non-accumulated electric energy from the mains. For such an embodiment the energy content of the accumulated, and thus the size can be considerably reduced. Moreover it enables to increase the average steam rate.

DETAILED DESCRIPTION OF THE INVENTION

Figure 1:
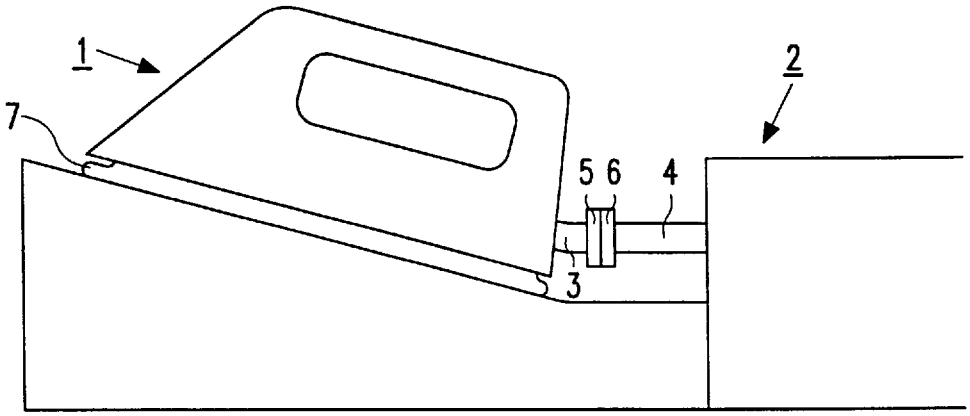
FIG. 1 shows schematically an iron arrangement with a cordless iron attached to a stand.

The invention will now be discussed in greater detail with reference to the figures of the drawing.

The iron arrangement of FIG. 1 comprises a cordless iron 1 and a stand 2.

The cordless iron can be detached from and attached to the stand. Energy transfer between the stand and the iron takes place via connecting leads 3,4 having coupling pieces 5,6 for the connection of the iron to the stand. The iron comprises a soleplate 7 receiving accumulated energy from the stand.

Figure 2:
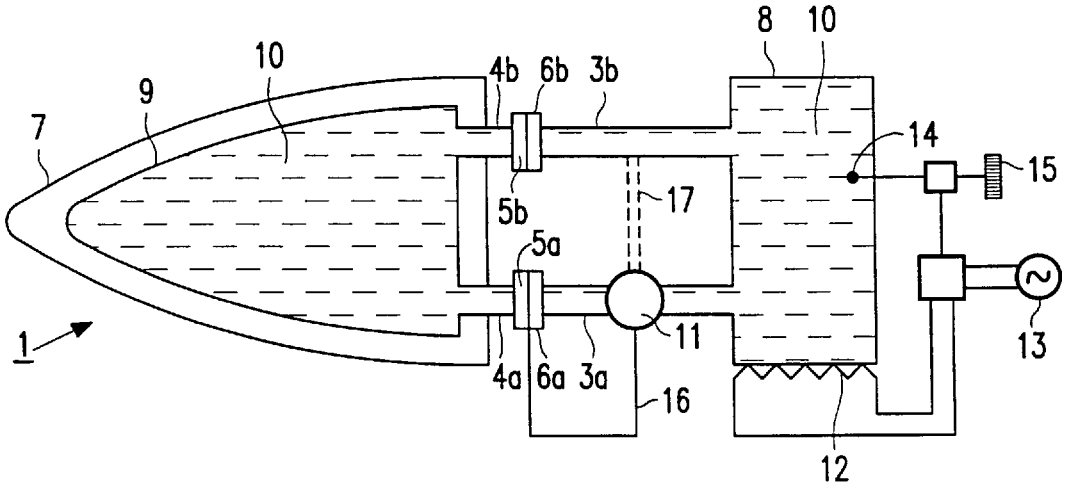
FIG. 2 is a schematic top view of the arrangement of FIG. 1 and shows an embodiment in which the stand comprises a storage tank for accumulating energy in the form of a hot liquid and a pump for the exchange of liquid between the storage tank and the reservoir.

In a first embodiment, shown in FIG. 2, the stand comprises a storage tank 8 and the iron comprises a reservoir 9, both filled with a liquid 10, such as glycerol. The reservoir 9 has an inlet tube 4*a* with a coupling piece 5*a* and an outlet tube 4*b* with a coupling piece 5*b*. The storage tank 8 has an outlet tube 3*a* with a coupling piece 6*a* and an inlet tube 3*b* with a coupling piece 6*b*. Each coupling piece has a valve (not shown). When the iron is attached to the stand the valves are automatically opened. In the outlet tube 3*a* a pump 11 is provided. The liquid in the storage tank 8 can be heated by an electric heating element 12. The electric heating element receives energy from the mains 13 by means of an electric current. The storage tank 8 is provided with a thermostat 14. The temperature of the liquid in the storage tank is adjustable by means of a knob 15. The operation of the arrangement is as follows: Assume that the iron is attached to the stand and the temperatures in the storage tank 8 and the reservoir 9 are equal. The user wants to iron fabrics and detaches the iron from the stand. During ironing, heat is delivered to the fabric, so that the temperature of the soleplate and thus the temperature of the liquid in the reservoir decreases. At the same time the liquid in the storage tank 8 is heated up to a predetermined temperature which is set by the knob 15. Usually the ironing time is longer than the time needed for heating up the liquid to a desired temperature. As soon as the iron is attached to the stand by connecting the respective coupling pieces, hot liquid from the storage tank 8 is pumped to the reservoir 9 and relatively cold liquid from the reservoir is pumped back to the storage tank. During this pumping, which takes only a few seconds, the temperature in the reservoir is at the desired value and the iron is ready for the next ironing operation. During heating a circulation of liquid in the storage tank 8 can be obtained by means of a small tube 17 between de pump 11 and the inlet tube 3*b* of the tank. The flow restriction in this small tube is much greater than in the other connection tubes, so that when the iron is attached to the stand hardly any liquid is flowing through the small tube, whereas when the iron is detached from the stand, liquid is circulating from one side of the tank through the small tube to the other side of the tank. The pump is working continuously. The result is a more homogeneous temperature of the liquid in the tank. In this embodiment it is possible to provide the stand with another storage tank containing a cold liquid. With a cold storage tank the iron can be cooled down very rapidly.

Figure 3:
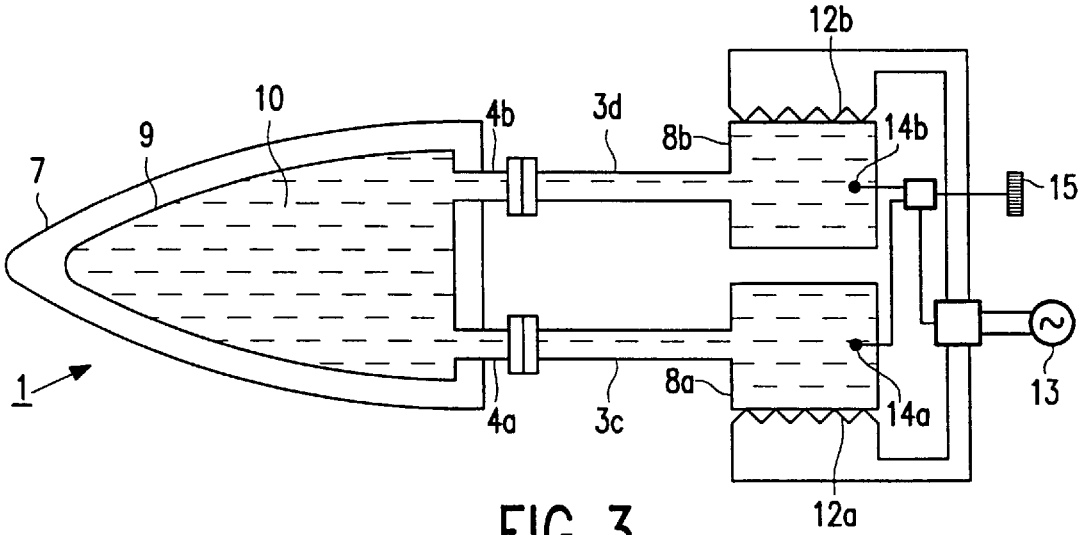
FIGS. 3–4 are schematic top views of the arrangement of FIG. 1 and show an embodiment in which the stand comprises two storage tanks for accumulating energy in the form of a hot liquid and vapour pressure is used for the exchange of liquid between the storage tanks and the reservoir.
Figure 4:
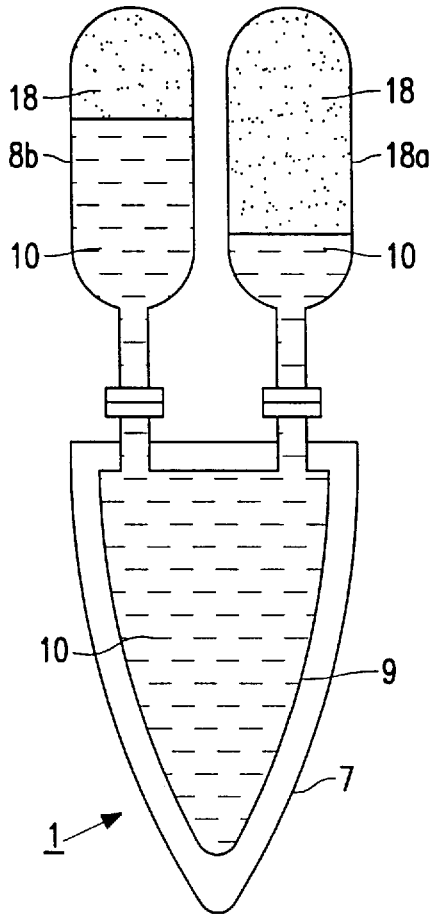

A modification of the above embodiment is shown in FIG. 3. There are two storage tanks 8*a* and 8*b* each having their own heating element 12*a* and 12*b* controlled by thermostats 14*a* and 14*b*. The connecting tubes 3*c* and 3*d*serve as inlet as well as outlet tubes for the liquid in the tanks 8*a* and 8*b*, respectively. For the liquid water is used, which means that to obtain e.g. a temperature of about 220° C. the water in the tanks and in the reservoir is at a pressure of about 24 bar. A pump is not necessary, because use can be made of differences in vapour pressure in the tanks for the exchange of water from the tank to the reservoir and vice versa. The operation of this arrangement will now be explained with reference to the simplified drawing of FIG. 4: Assume that the iron 1 is attached to the stand 2 and the water in the reservoir 9 is at about ironing temperature, so that the iron is ready for use. The tanks are partly filled with water, leaving an amount of air above the water. The masses of air in both tanks are about the same and remain the same during the operation. As long as the iron is attached to the stand, the tanks are in communication with each other by means of the reservoir. Suppose that the temperature in tank 8*a* is higher than in tank 8*b*. The iron is detached from the stand for ironing. After a certain ironing time, the water in the reservoir has cooled down due to the ironing process, so that the pressure in the reservoir has decreased. Then the iron is again attached to the stand. The pressure in the tank 8*a* is higher than in the reservoir 9 and also higher than in the tank 8*b*. The pressure difference causes water to flow from the tank 8*a* into the reservoir 9 and at the same time relatively cold water from the reservoir is forced into the tank 8*b*. So, cold water in the reservoir is replaced by hot water from the tank 8*a*. As soon as water starts to flow, the volume of the vapour 18 and air in tank 8*a* increases, resulting in a pressure drop. The vapour is no longer saturated and the water starts to boil. Water evaporates until the vapour is fully saturated again. The energy needed for evaporation is taken from the water in the tank 8*a*, resulting in a temperature drop. When the pressures in both tanks are equal again water stops to flow. The iron soleplate has the desired temperature and can again be detached from the tank for ironing. The heating element 12*b* for the tank 8*b* is now switched on. The tank 8*b* is heated until the water has the desired temperature which is controlled by the thermostat 14*b*. The tank 8*b*has now become a 'hot tank'. The pressure in tank 8*b* has increased at the same time. After heating the water in the tank 8*b*, the temperature and pressure in the tank 8*b* is higher than in the tank 8*a*. The tank 8*a* is now a 'cold tank'. The vapour 18 in both tanks is saturated. The iron is again attached to the stand. As the pressure in tank 8*b* is higher than in the tank 8*a*, water starts to flow from tank 8*b* into the reservoir 9 and from the reservoir 9 into tank 8*a*. So, the water flows now in the opposite direction.

If a user wants to iron and the iron is attached to the stand while the water in the tanks and the reservoir is at room temperature or in any case far below the ironing temperature, the heating element of one of the tanks, say the tank 8*a*, is switched on. The pressure and temperature in the tank 8*a* increase and due to pressure difference water starts to flow from the tank 8*a* to the reservoir 9 and at the same time cooled down water from the reservoir is forced to the tank 8*b*. After a certain time the tank 8*b* is full (except for an air space), but the desired soleplate temperature has not yet been reached. Then the heating element 12*a* is switched off and heating element 12*b* for tank 8*b* is switched on. The water in the tank 8*b* is heated and the pressure rises. The pressure in tank 8*b* is higher than in the tank 8*a* and water flows in the reverse direction. This is repeated several times until the desired soleplate temperature is reached. This on-off switching of the heating elements may also occur if the iron is left on the stand for a certain time because the user needs more time for re-arranging the clothes to be ironed.

Figure 5:
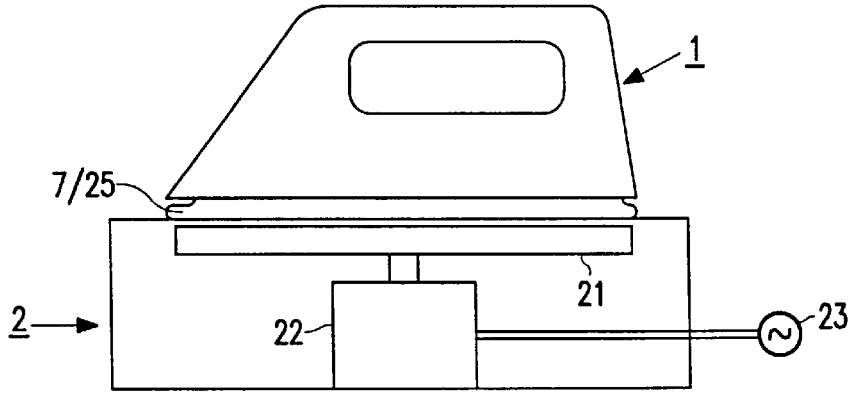
FIGS. 5–6 show an embodiment in which a flywheel is used to accumulate energy and an inductive coupling to transfer the energy to the iron and FIG. 7 shows an embodiment in which a capacitor is used to accumulate the energy.
Figure 6:
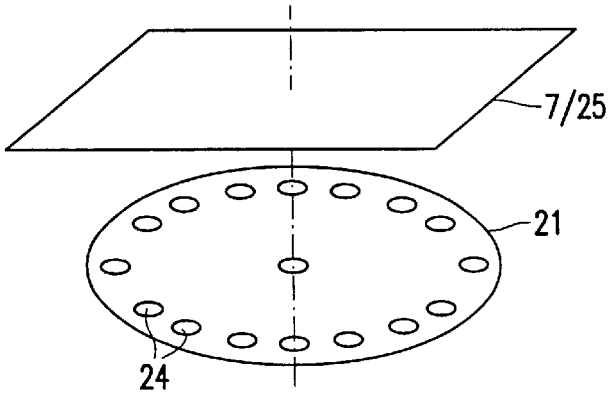

In a second embodiment, shown in FIG. 5, a flywheel 21 is accommodated in the stand 2. The flywheel is driven by an electric motor 22 receiving the energy from the mains 23. A spinning flywheel can accumulate a considerable amount of rotational energy. To transfer this energy to the iron the flywheel comprises a plurality of magnets 24 and the iron comprises a magnetizable plate 25. The magnetizable plate may be a separate plate which is in heat-conducting contact with the soleplate or it may be the soleplate itself. The magnets are preferably arranged at the rim of the flywheel. Energy transfer takes place by means of inductive coupling between the flywheel and the magnetisable (sole)plate (see FIG. 6). When the iron is attached to the stand, the (sole) plate is located just above the flywheel. The magnets induce a locally oscillating magnetic field in the plate. As a result, eddy currents will be induced which counteract the forced changes in the magnetic field. The ohmic losses from the eddy currents generate heat in the (sole)plate. Calculations have shown that with the data given hereafter an iron arrangement based on the transfer of accumulated energy from a flywheel to the soleplate of an cordless iron is feasible.

It is assumed that a flywheel has the following data:

radius r=0.06 m thickness t=0.02 m material steel $\rho$=8000 kg/m$^3$ speed n=40,000 r.p.m.

the flywheel carries 14 SmCo magnets, each with an area of 1 cm$^2$ at an effective radius $r_{eff}$=0.045 m air gap between magnets and iron plate: 1 mm.

From the above data it can be calculated that the energy content of the flywheel is:

$$E=J^*\tfrac{1}{2}\omega^2=\tfrac{1}{2}\rho\pi r^4 t^*\tfrac{1}{2}\omega\rightarrow E\approx 28kJ$$

The speed of the magnets can be calculated: $v=n/60^*2\pi r_{eff}\approx 188$ m/s During the transfer of energy to the iron, the speed of the flywheel decreases. For flywheels it is customary to allow the speed not to decrease any further than half the maximum speed. If the speed of the flywheel decreases from maximum to half of the maximum speed the energy content is reduced to ¼ of the maximum. So, 21 kJ can be transferred. Using the Maxwell equations and finite element calculations it can be calculated that at a speed of 188 m/s the power transfer is about 60 kW. At a speed of 94 m/s (half of the maximum speed) this power transfer is about 27 kW. From the above calculations it is clear that it is possible to transfer e.g. at least 20 kW to the iron. The time to transfer 20 kW is only 2 s. Most known cordless irons have a heating element with a power of about 1.4 kW. This means that 21 kJ can be transferred to the iron during an idle time of 15 s. So, energy transfer by means of a flywheel is possible within a very short time period.

Figure 7:
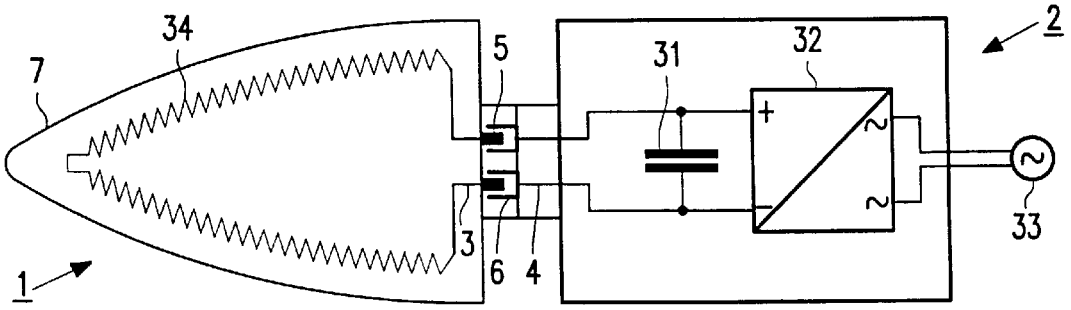

In a third embodiment of the invention, shown in FIG. 7, the means for accumulating energy comprises a capacitor 31, which is charged from the mains supply 33 via a rectifier bridge 32 when the cordless iron is detached from the stand. The iron comprises an electric heating resistor 34 which heats the soleplate. When the iron is attached to the stand, the capacitor is discharged through the heating resistor and the soleplate is heated up for the next ironing operation.

Usually the energy supply is the electric mains supply, but alternatively any other electrical supply or centralized supply, such as e.g. steam supply may be considered as energy supply.

It is also possible to use a combination of reheating the soleplate by means of accumulated energy from the stand, according to the present invention, and by means of the customary heating as used in the known cordless irons up to now.

We claim:

1. An iron arrangement comprising a cordless iron and a stand, said iron having a soleplate, said stand receiving energy from an energy supply, said arrangement comprising transfer means for transferring said energy to the iron for heating said iron when the iron is attached to the stand characterized in that the stand comprises means for accumulating said energy, said transfer means transferring said accumulated energy when the iron is attached to the stand and said accumulated energy thus transferred to the iron providing a heat source in the iron sufficient to heat a portion of the iron for a substantial period subsequent to removal of the iron from the stand.

2. An iron arrangement as claimed in claim 1, characterized in that the means for accumulating energy comprises a storage tank containing a liquid, said stand comprising heating means for heating the liquid in the storage tank, said iron having a soleplate and a reservoir for receiving said heated liquid from the storage tank, said heated liquid in the reservoir being in heat-conducting contact with the soleplate for heating said soleplate, both said reservoir and said storage tank comprising an inlet and an outlet tube for the liquid, the respective inlet and outlet tubes of the reservoir and the storage tank being connectable to each other when the iron is attached to the stand, said stand comprising a pump for pumping the liquid from the storage tank to the reservoir and vice versa.

3. An iron arrangement as claimed in claim 2, wherein the liquid is water.

4. An iron arrangement as claimed in claim 2 wherein the liquid is water.

5. An iron arrangement as claimed in claim 2 wherein the liquid is glycerol.

6. An iron arrangement as claimed in claim 1, characterized in that the means for accumulating energy comprises a first and a second storage chamber each containing a liquid, said stand comprising heating means for heating the liquid in either the first or the second storage chamber, said iron having a soleplate and a reservoir for receiving said heated liquid from one of the storage chambers, said heated liquid in the reservoir being in heat-conducting contact with the soleplate for heating said soleplate, said reservoir comprising an inlet and an outlet tube for the liquid, said storage chambers each having one connecting tube for the liquid, the inlet and the outlet tubes of the reservoir being connectable to the respective connecting tubes of the storage chambers when the iron is placed on the stand.

7. An iron arrangement as claimed in claim 6 wherein the liquid is water.

8. An iron arrangement as claimed in claim 6 wherein the liquid is water.

9. An iron arrangement as claimed in claim 1, characterized in that the means for accumulating energy comprises a motor driven flywheel having a plurality of magnets, said iron having a magnetizable plate which is in heat-conducting contact with the soleplate, the accumulated rotational energy of the flywheel being transferred to the magnetizable plate by induction for heating the sole plate when the iron is attached to the stand.

10. An iron arrangement as claimed in claim 1, characterized in that the means for accumulating energy comprises a capacitor, said cordless iron comprising a soleplate and an electric heating resistor being in thermal contact with the soleplate, the electric charge accumulated in the capacitor being transferred to the resistor through electric conductors for heating the soleplate when the iron is attached to the stand.

11. An iron arrangement as claimed in claim 1, characterized in that, when the iron is attached to the stand, the accumulated energy is transferred to the iron for heating a steam chamber whereas the soleplate is heated by means of electric energy received directly from the electric mains via the stand.

* * * * *